United States Patent [19]

Park

[11] Patent Number: 4,699,069

[45] Date of Patent: Oct. 13, 1987

[54] BOILER OR FURNACE

[76] Inventor: Thompson Park, 35 South Street, Lytton Industrial Estate, Lytton, Queensland, 4178, Australia

[21] Appl. No.: 886,356

[22] Filed: Jul. 17, 1986

[51] Int. Cl.[4] ..... F23B 7/00

[52] U.S. Cl. ..... 110/234; 110/293; 122/15

[58] Field of Search ..... 122/15; 110/234, 293, 110/102

[56] References Cited

U.S. PATENT DOCUMENTS

| | | | |
|---|---|---|---|
| 2,452,843 | 11/1948 | Pelterie | 110/293 |
| 4,312,278 | 1/1982 | Smith et al. | 110/234 |
| 4,413,571 | 11/1983 | Hill et al. | 122/15 X |
| 4,461,243 | 7/1984 | Carpaneto | 122/15 |
| 4,530,289 | 7/1985 | Godbout | 110/234 X |
| 4,562,777 | 1/1986 | van der Voort | 122/15 X |

*Primary Examiner*—Edward G. Favors

*Attorney, Agent, or Firm*—Larson and Taylor

[57] ABSTRACT

A boiler has a cylindrical body separated into two chambers by a transverse inner water chamber. A fuel magazine leads to one of the chambers, while a cyclone with a flue leads from the second chamber, the two chambers being connected by a sinuous combustion gas passage. A horizontal wall extends across the top of the cyclone and the combustion gas enters the second chamber adjacent the wall to descend into the cyclone. On ascending, a portion of the gases impinge on the wall and is caused to descend to create a circulatory motion in the cyclone.

6 Claims, 6 Drawing Figures

BOILER OR FURNACE

BACKGROUND OF THE INVENTION

THIS INVENTION relates to an improved boiler or furnace.

SUMMARY OF THE PRESENT INVENTION

The general object is to provide a boiler for the supply of hot water and/or steam, or a furnace which is efficient in operation and which is generally low in pollution.

The invention resides broadly, in one embodiment, in a boiler including:

a cylindrical outer water chamber;

a substantially diametrical or transverse inner water chamber;

a vertical fuel magazine leading to a lower combustion chamber on one side of the inner water chamber;

a cyclone with a flue on the other side of the inner water chamber; and a combustion gas passage connecting the lower combustion chamber to the cyclone, wherein:

a substantially horizontal wall extends across the top of the cyclone, the combustion gas passing having its outlet adjacent the wall, and the inlet to the flue is provided in the wall so arranged that the combustion gases descend through the outlet of the combustion gas passage to the cyclone and on ascending, a portion of the gases impinge on or engage the wall and cause the gases to descend to create a circulatory motion in the cyclone.

The invention, in a second embodiment, may be applied to a furnace in which the water chambers are replaced by refractory structures.

In a small boiler or furnace, only one fuel magazine and cyclone may be employed, while in larger units, two or more fuel magazines and cyclones may be provided. For example, the inner water chamber may divide the boiler into four quadrants each having a respective fuel magazine and cyclone.

BRIEF DESCRIPTION OF THE DRAWINGS

To enable the invention to be fully understood, a preferred embodiment of a boiler will now be described with reference to the accompanying drawings, in which.

DETAILED DESCRIPTION OF THE PREFERRED EMBODIMENTS

Figure 3:
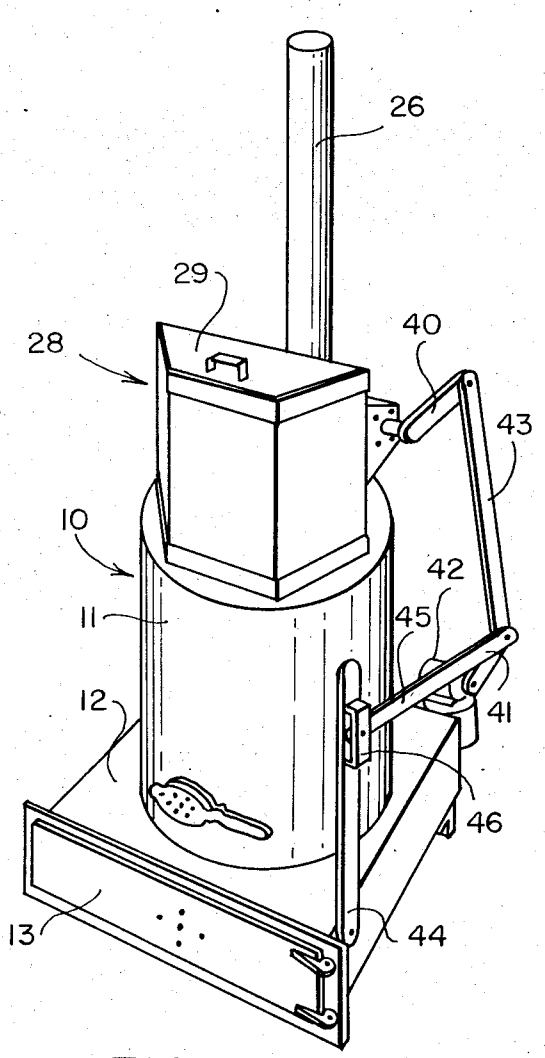
FIGS. 3 and 4 are front and rear views, respectively, of the boiler in its operating configuration and showing the operating mechanism for a coal agitation in the fuel magazine and the fire bars.
Figure 2:
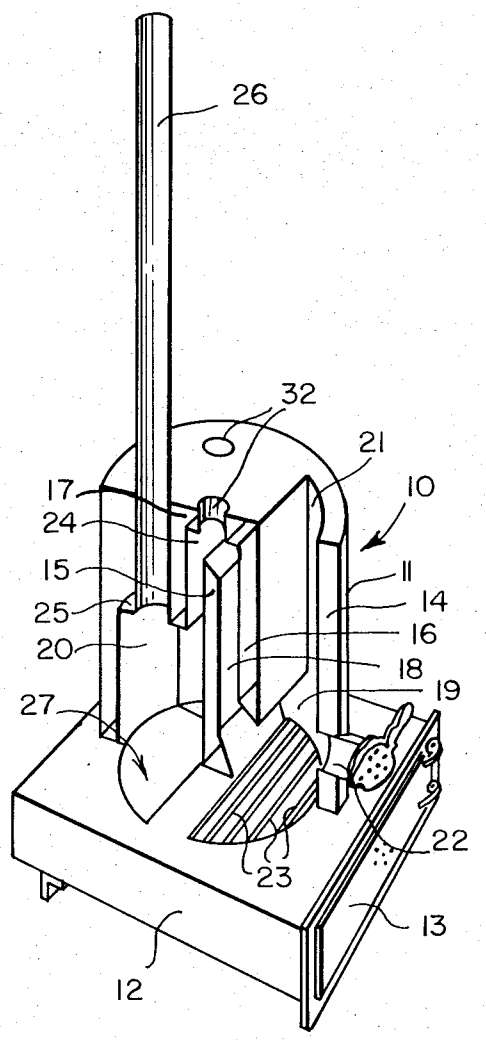
FIG. 2 is a part sectional view of the boiler.
Figure 1:
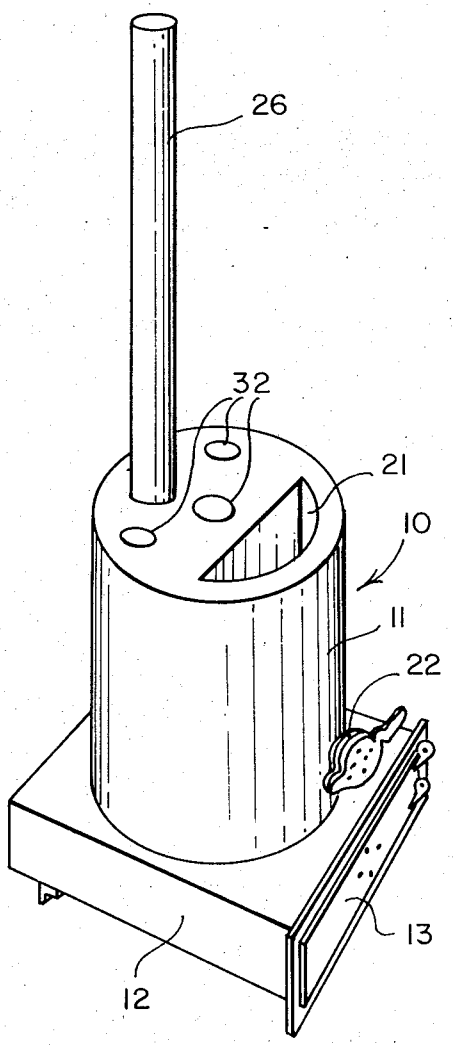
FIG. 1 is an external view of the basic boiler.

The boiler 10 has a cylindrical outer casing 11 mounted on an ash-box base 12. A vented hinged door 13 at the front allows access to the ash-box for removal of the spent ashes, while a door 13*a* at the rear enables removal of the grit.

The outer casing 11 forms an outer water chamber 14, in the form of a double-walled cylinder, for receiving water between its inner and outer walls. An inner water chamber 15 extends diametrically across the outer water chamber 14 and together with substantially parallel secondary waterchambers, 16, 17 form an inverted U-shaped combustion gas passage 18 interconnecting the combustion chamber 19 with the cyclone 20 on opposite sides of the inner water chamber 15.

A vertical fuel magazine 21 e.g. to receive coke or coal, is provided above the combustion chamber 19 which also has a controlled air inlet 22 and movable fire bars 23 (the latter mounted in the ash-box 12).

The inlet 24 to the cyclone 20 extends across one side thereof adjacent the inner water chamber 15. The top wall 25 of the cyclone is in the form of a segment and closes the top of the cyclone. A flue 26 has its inlet formed in the top wall with an inlet area not more than 50% the area of the top wall.

The bottom of the cyclone 20 is open via a hole 27 leading to the ash-box 12.

In operation, the fuel magazine 21 is filled e.g. with coal, and the combustion chamber 19 is ignited, the rate of combustion being controlled by the air inlet 22. The combustion gases ascend the first portion of the passage 18 and then descend to the cyclone 20 via its inlet 24. In the cyclone, the gases ascend and a portion flows directly out of the flue 26. However, the major portion of the gases impinge on the top wall 25 and are deflected downwardly to create a circulatory motion in the cyclone as indicated by the arrows. Particulates or solids in the gases are expelled via the hole 27 to the ash-box and so the gases exhausted via the flue 26 have little solids content. (the particulates and solids are removed from the ash-box via the door 13*a*).

Figures 4, 5, 6:
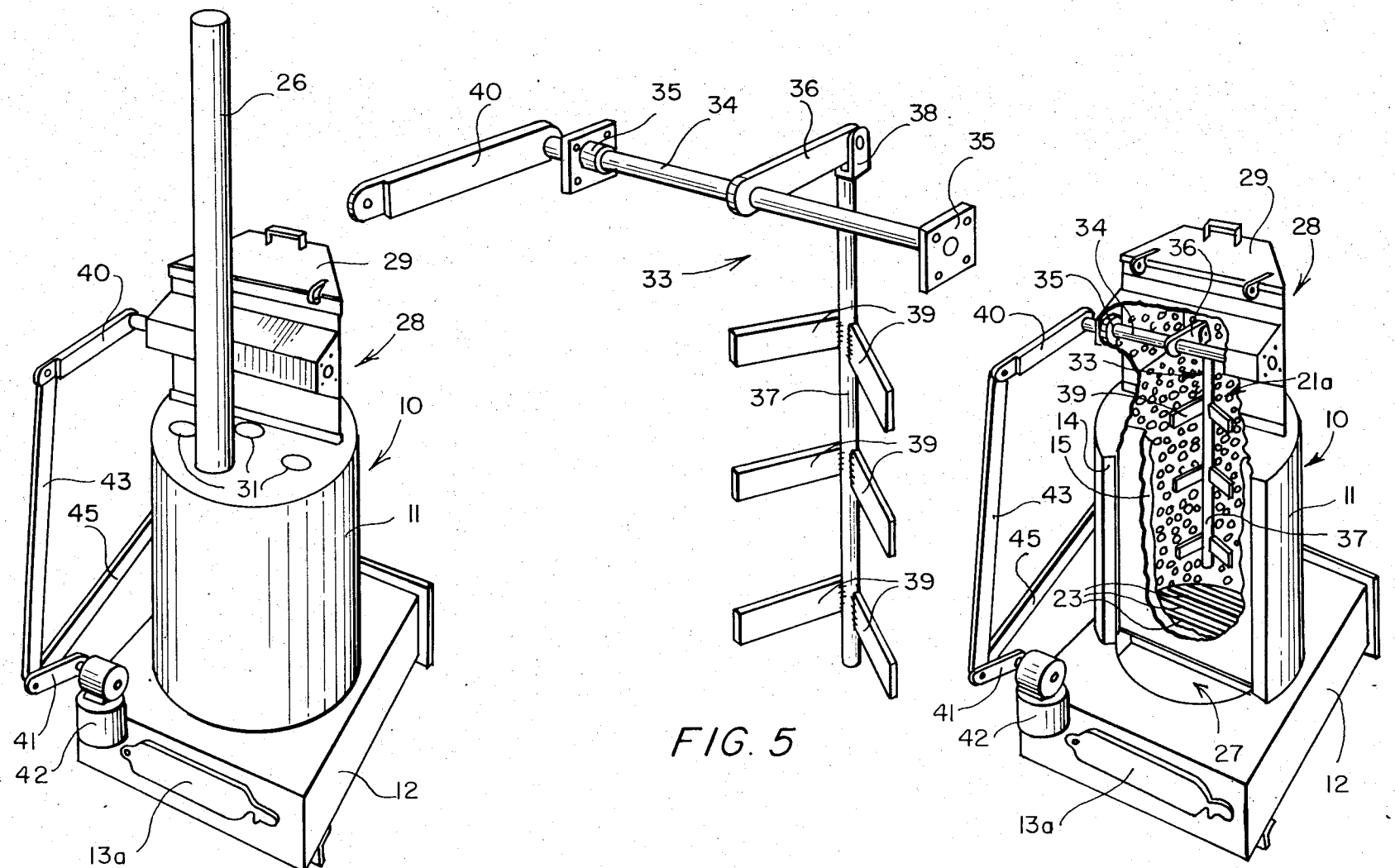
FIG. 5 is a schematic view of the fuel agitator.
FIG. 6 is a part-sectional rear view showing the coal agitation inside the fuel magazine.

Referring now to FIGS. 3–6, the boiler 10 is shown in its operating configuration, with a magazine extension 28 shown mounted above the fuel inlet 21*a*, the magazine having a hinged loading door 29. Removable doors in the base plate 31 of the extension allow access to peep holes 32 in the combustion gas passage 28.

In certain applications, the coal in the fuel magazine 21 and the magazine extension will not fall into the combustion chamber 19. To overcome this problem an agitator 33 is fitted in the fuel magazine and magazine extension. The agitator 33 has an operating shaft 34 journalled in bearings 35 in the side faces of the magazine extension 28 and an arm 36 on the shaft is connected to the upper end of a vertical operating rod 37 via a clevis 38. U- or V- shaped bars 39 on the operating rod 37 agitate the coal as the rod is reciprocated in a vertical direction causing the coal to fall into the combustion chamber 19.

To drive the agitator 33, a lever 40 is fixed to one end of the operating shaft 34 and is attached at its other end to a crank 41 on a geared motor 42 via a vertical link 43.

The motor 42 also reciprocally drives the fire bars 23 which have an operating lever 44. A drive lever 45 interconnects the crank 41 to an extension arm 46 on the lever 44.

It will be readily apparent to the skilled addressee that the circulatory motion in the cyclone promotes efficient combustion of the gases and that the principal of the invention is also applicable to a furnace.

Various changes and modifications may be made to the embodiments described without departing from the present invention defined in the appended claims.

I claim:

1. A boiler including:

a cylindrical outer water chamber;

a substantially diametrical or transverse inner water chamber;

a vertical fuel magazine leading to a lower combustion chamber on one side of the inner water chamber;

a cyclone with a flue on the other side of the inner water chamber; and a combustion gas passage connecting the lower combustion chamber to the cyclone, wherein:

a substantially horizontal wall extends across the top of the cyclone, the combustion gas passage having its outlet adjacent the wall, and the inlet to the flue is provided in the wall so arranged that the combustion gases descend through the outlet of the combustion gas passage to the cyclone and on ascending, a portion of the gases impinge on or engage the wall and cause the gases to descend to create a circulatory motion in the cyclone.

2. A boiler as claimed in claim 1 wherein:

the inner water chamber is substantially diametrical to the outer water chamber; and the combustion gas passage is of substantially inverted U-shape.

3. A boiler as claimed in claim 1 wherein:

the inlet to the cyclone, formed by the outlet from the combustion gas passages, extends across one side of the cyclone adjacent the inner water chambers; and the inlet to the flue is formed in the horizontal wall, spaced from the inlet to the cyclone.

4. A boiler as claimed in claim 3 wherein:

the area of the inlet to the flue is not more than 50% of the area of the horizontal wall.

5. A boiler as claimed in claim 1 wherein:

a vertically reciprocating agitator is mounted in the fuel magazine, and/or in the magazine extension to the fuel magazine, to agitate the fuel in the magazine to cause it to fall into the combustion chamber.

6. A boiler as claimed in claim 5 wherein:

a motor with a crank is operatively connected to the agitator and to fire bars in the combustion chamber to promote the combustion of the fuel.

* * * * *